US006986174B2

(12) United States Patent
Brown

(10) Patent No.: US 6,986,174 B2
(45) Date of Patent: Jan. 17, 2006

(54) SINK MOUNTING DEVICE AND SYSTEM

(75) Inventor: Richard Brown, Midland (CA)

(73) Assignee: Nitro-Plan AG, Aarburg (CH)

( * ) Notice: Subject to any disclaimer, the term of this patent is extended or adjusted under 35 U.S.C. 154(b) by 92 days.

(21) Appl. No.: 10/700,578

(22) Filed: Nov. 5, 2003

(65) Prior Publication Data

US 2005/0050629 A1 Mar. 10, 2005

(30) Foreign Application Priority Data

Sep. 10, 2003 (CA) ..... 2440673

(51) Int. Cl.
*E03C 1/33* (2006.01)

(52) U.S. Cl. ..... 4/631; 4/633; 4/634

(58) Field of Classification Search ..... 4/631, 4/633, 634; 312/140.4
See application file for complete search history.

(56) References Cited

U.S. PATENT DOCUMENTS

| | | | | |
|---|---|---|---|---|
| 2,846,695 A | | 8/1958 | Hartog | |
| 2,925,609 A | | 2/1960 | Richardson | |
| 3,029,445 A | | 4/1962 | Just | |
| 3,821,052 A | * | 6/1974 | Tanzer | 156/250 |
| 4,613,995 A | | 9/1986 | Ricke | |
| 5,538,206 A | | 7/1996 | Sather | |
| 5,743,501 A | | 4/1998 | Rapp | |
| 5,778,617 A | * | 7/1998 | Free | 52/255 |
| 6,216,992 B1 | | 4/2001 | Bisonaya et al. | |
| 6,779,835 B2 | * | 8/2004 | Fox et al. | 296/187.05 |
| 2002/0014572 A1 | * | 2/2002 | Albritton | 248/674 |
| 2004/0049844 A1 | * | 3/2004 | Stone | 4/631 |

FOREIGN PATENT DOCUMENTS

| | | | |
|---|---|---|---|
| JP | 05277040 A | * | 10/1993 |
| JP | 2000-1650 A | * | 1/2000 |

* cited by examiner

*Primary Examiner*—Khoa D. Huynh
(74) *Attorney, Agent, or Firm*—Bereskin & Parr

(57) ABSTRACT

A mounting device for securing a sink to a countertop including a mounting plate and a support member. The mounting plate has a plurality of perforations which are sufficiently large to permit seaming compound to flow therethrough. The support member includes a mounting flange and a support flange. The mounting flange is adapted to secure the support member to the mounting plate, and the support flange is adapted to contact and support the sink flange.

9 Claims, 10 Drawing Sheets

SINK MOUNTING DEVICE AND SYSTEM

FIELD OF THE INVENTION

This invention relates to mounting devices, and in particular, to mounting devices for securing a sink to a countertop.

BACKGROUND OF THE INVENTION

The rapid growth of the new home construction and remodeling industries has generated a need for quick and inexpensive construction techniques. This is especially true in respect to kitchen and bathroom installations. Various devices have been developed for mounting a sink to the underside of a countertop. Typically, these devices utilize a hanging clip which engages beneath the sink flange and is secured to the countertop using a threaded fastener and anchor.

In a standard undermount sink installation, a cutout corresponding to the dimensions of the sink is made in the countertop using a template. The installer then positions the sink such that the sink flange is equidistant to the cutout and skillfully drills holes on the underside of the countertop to receive the fasteners. The threaded portion of the fastener engages the hanging clip and is tightened against the countertop to secure the clip and sink flange. When working with expensive countertop materials, such as granite and marble, the installer must carefully drill and insert the fasteners to avoid cracking or otherwise damaging the countertop material. Similarly, drilling and inserting fasteners into man-made countertop materials often produces protuberances which mar the appearance of the countertop surface. Furthermore, the installer must also be aware of the specific drills and fasteners that a manufacturer may recommend for use with its countertop materials. For instance, many manufacturers commonly recommend that lead fasteners be used with marble countertops.

Given the time, skill and tools required to install mounting devices in this fashion, it is often necessary that the sink be mounted to the countertop at an off-site workshop. This is not feasible in many remodeling applications in which the existing countertop is not being replaced, or when the remodeling must be completed within a short period of time. Furthermore, sinks mounted off-site will invariably require on-site adjustments to fit within the cabinetry. A mounting device comprising of a hanging clip and a fastener drilled into the underside of the countertop will be very difficult to adjust within the confined space beneath the sink. However, such adjustments are crucial to ensure a tight fit between the sink and the countertop, and to prevent the leakage of water into the cabinet and onto the floor.

Accordingly, there is a need for a sink mounting device which is relatively easy to install and adjust in confined spaces, and which does not require invasive drilling into the countertop material.

SUMMARY OF THE INVENTION

In a first aspect, the invention is directed to a mounting device for securing a sink, having a sink flange, to a countertop. The mounting device includes a mounting plate and a support member. The mounting plate has a plurality of perforations which are sufficiently large to permit seaming compound to flow therethrough. The support member includes a mounting flange and a support flange. The mounting flange is adapted to secure the support member to the mounting plate, and the support flange is adapted to contact and support the sink flange.

The mounting device may include a mounting plate having an aperture and a mounting flange having a slot. The mounting device includes a bolt which is adapted to extend through the slot and is received within the aperture to secure the mounting plate to the mounting flange. The mounting device may also include a support flange having a fastener for supporting the sink. The support flange may be adapted to couple to said sink flange.

The seaming compound may be an epoxy, an acrylic-based, a polyester-based, a cyanoacrylate-based or a urethane-based compound.

In a second aspect, the invention is directed to a system for under mount securing a sink having at least one sink bowl and at least one sink flange to a countertop. The system comprises at least a first layer of seaming compound applied to the bottom surface of the countertop. The system further comprises a plurality of mounting devices including a mounting plate having perforations to enable the first layer of seaming compound to flow therethrough. The mounting device includes a support member, the support member has a mounting flange and a support flange. The mounting flange is adapted for retaining the support member to the mounting device. The support flange is adapted to contact the sink flange and support the sink. The plurality of mounting devices are adapted to be spaced horizontally from each other when secured to the countertop.

At least one second layer of seaming compound may be generally applied to the mounting device so as to bond the mounting plate integrally with the first and second layers of seaming compound.

In a third aspect, the invention is directed to a method of attaching a mounting device for undermount securing a sink to a countertop, wherein the countertop is made from solid materials selected from the group consisting of naturally occurring materials and man-made materials. The method comprises the selection of a sink and a seaming compound, wherein the sink includes at least one sink bowl and at least one sink flange and the seaming compound is intended for creating seams in the solid material. A mounting device is provided, wherein the mounting device includes a mounting plate having a plurality of perforations which are sufficiently large to permit seaming compound to flow therethrough. The mounting device also includes a support member, wherein the support member includes a mounting flange and a support flange. The mounting flange is adapted for retaining the support member to the mounting plate. The support flange is adapted to contact the sink flange and support the sink. The method further comprises applying a first layer of the selected seaming compound to the bottom surface of the countertop and bringing the mounting plate into contact with the seaming compound. The mounting plate is then pressed into the seaming compound to force a portion of the seaming compound through the plurality of perforations and so as to bond the mounting plate with the first layer of the seaming compound.

A second layer of selected seaming compound may be applied over the perforations and around the perimeter of the mounting plate to bond the mounting plate integrally with the first and second layers of seaming compound.

BRIEF DESCRIPTION OF THE DRAWINGS

For a better understanding of the present invention and to show clearly how it may be carried into effect, reference will now be made, by way of example, to the accompanying drawings which show preferred embodiments of the present invention and in which.

DETAILED DESCRIPTION OF THE INVENTION

Figure 1:
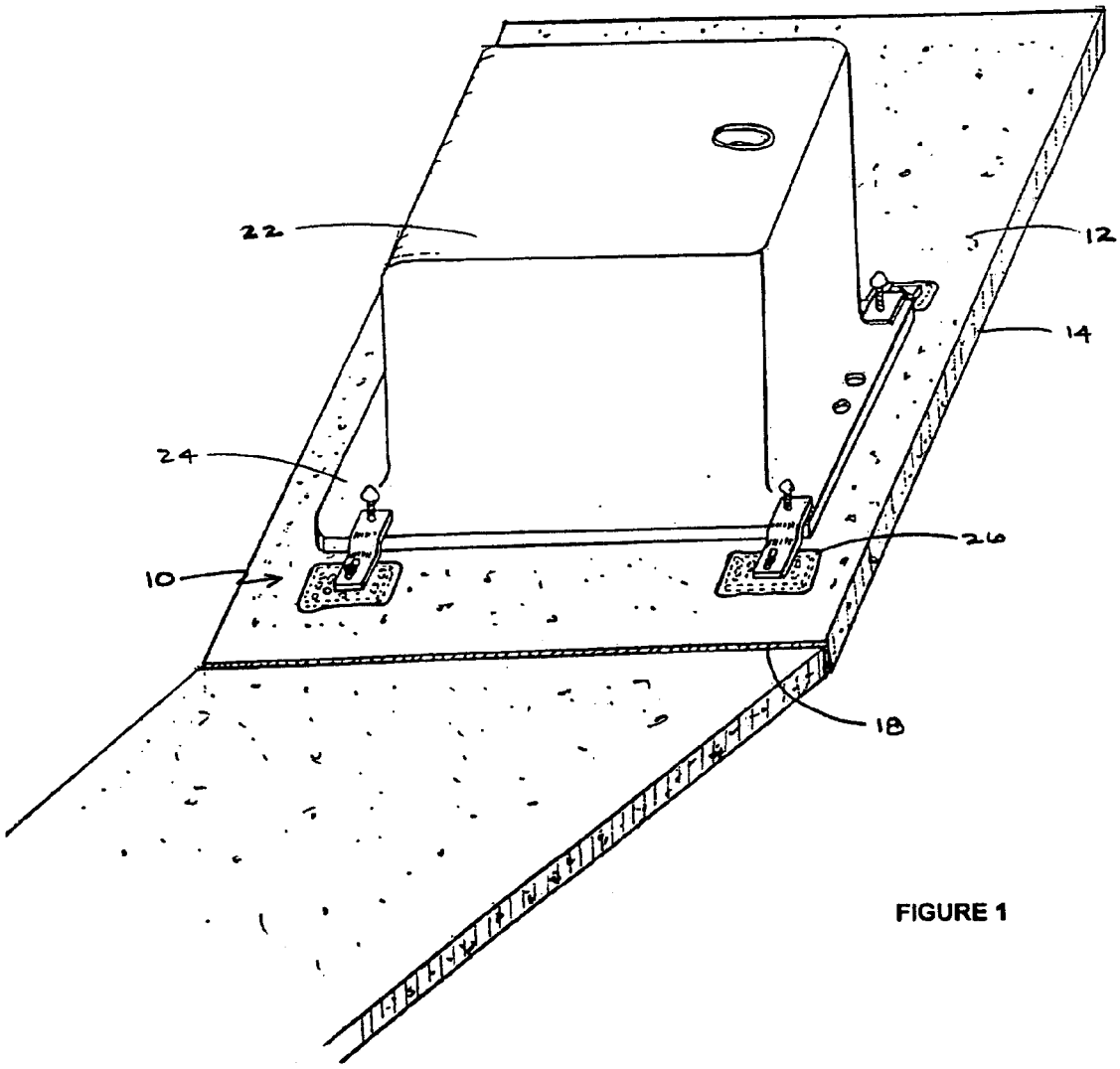
FIG. 1 is a perspective view of a system of mounting devices supporting a sink on the underside of a countertop in accordance with a preferred embodiment of the present invention.
Figure 2:
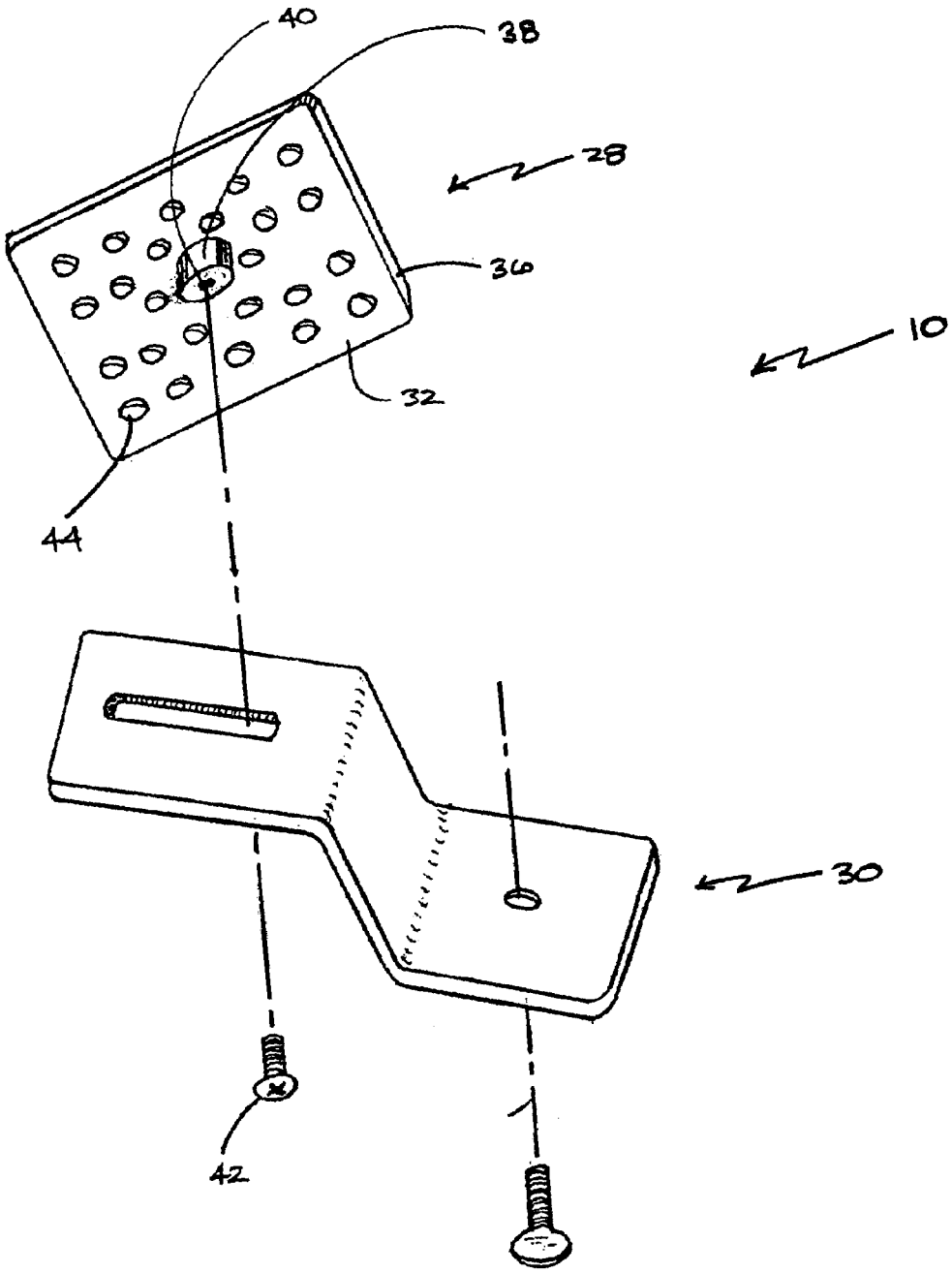
FIG. 2 is an exploded view of the components of a mounting device of FIG. 1.

Reference is made to FIGS. 1 and 2 which illustrate a mounting device 10 made in accordance with a preferred embodiment of the invention. The mounting device 10 is mounted on the underside 12 of a countertop 14. The countertop 14 comprises a seam 18 and a cutout 20. The mounting device 10 is adapted for securing a sink 22 having a sink flange 24 to the underside 12 of the countertop 14 using a seaming compound 26. The mounting device 10 comprises a mounting plate 28 and a support member 30. The mounting device 10 may be made of any suitable material, such as 12 or 13 gauge stainless steel. The countertop 14 may be made from any naturally occurring materials, such as granite and marble, or man-made materials, such as metal, solid-surface veneer, acrylic and polyester materials, and plastic.

Figure 3:
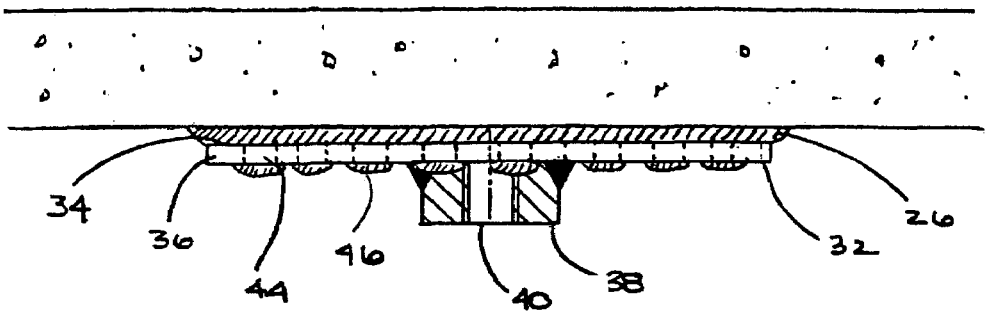
FIG. 3 is an enlarged elevation view of the mounting plate of the mounting device of FIG. 2.

Referring to FIGS. 2 and 3, the mounting plate 28 may have a generally rectangular shape and has a bottom surface 32, a top surface 34 and a perimeter 36. The bottom surface 32 includes a mounting means 38 having an aperture 40 and a fastener 42. Aperture 40 is adapted to receive the fastener 42 to secure the mounting plate 28 to the support member 30, as will be discussed further below. Fastener 42 may be any suitable means, such as, for example, a mechanical fastener.

Mounting plate 28 includes a plurality of perforations 44 which extend from the bottom surface 32 through to the top surface 34. The perforations 44 may be generally circular, and may be sized to be sufficiently large to permit the seaming compound 26 that is applied to the underside 12 of the countertop 14 to flow through the perforations 44. Preferably, the perforations 44 are designed to allow the seaming compound 26 to pass therethrough and onto the bottom surface 32, as shown in FIG. 3. The seaming compound 26 which is forced through the perforations 44 as the mounting plate 28 is pressed against the countertop 14 forms a plurality of buttons 46, with one button forming under each perforation 44. It will be noted that the surface area of top surface 34 of the mounting plate 28 and the size of the perforations 44 may be designed so as to maximize the strength of the bond between the mounting plate 28 and the seaming compound 26.

The adhesion occurs in several ways. Firstly, the seaming compound is specially formulated for bonding with the selected countertop material. Secondly, the seaming compound adheres to the surface 34 of the mounting plate 28. Thirdly, the column of seaming compound which is in the perforation 44 adheres to the wall of the perforation. Fourthly, the button 46 partially adheres to the surface 32 of the mounting plate 28.

Figure 4:
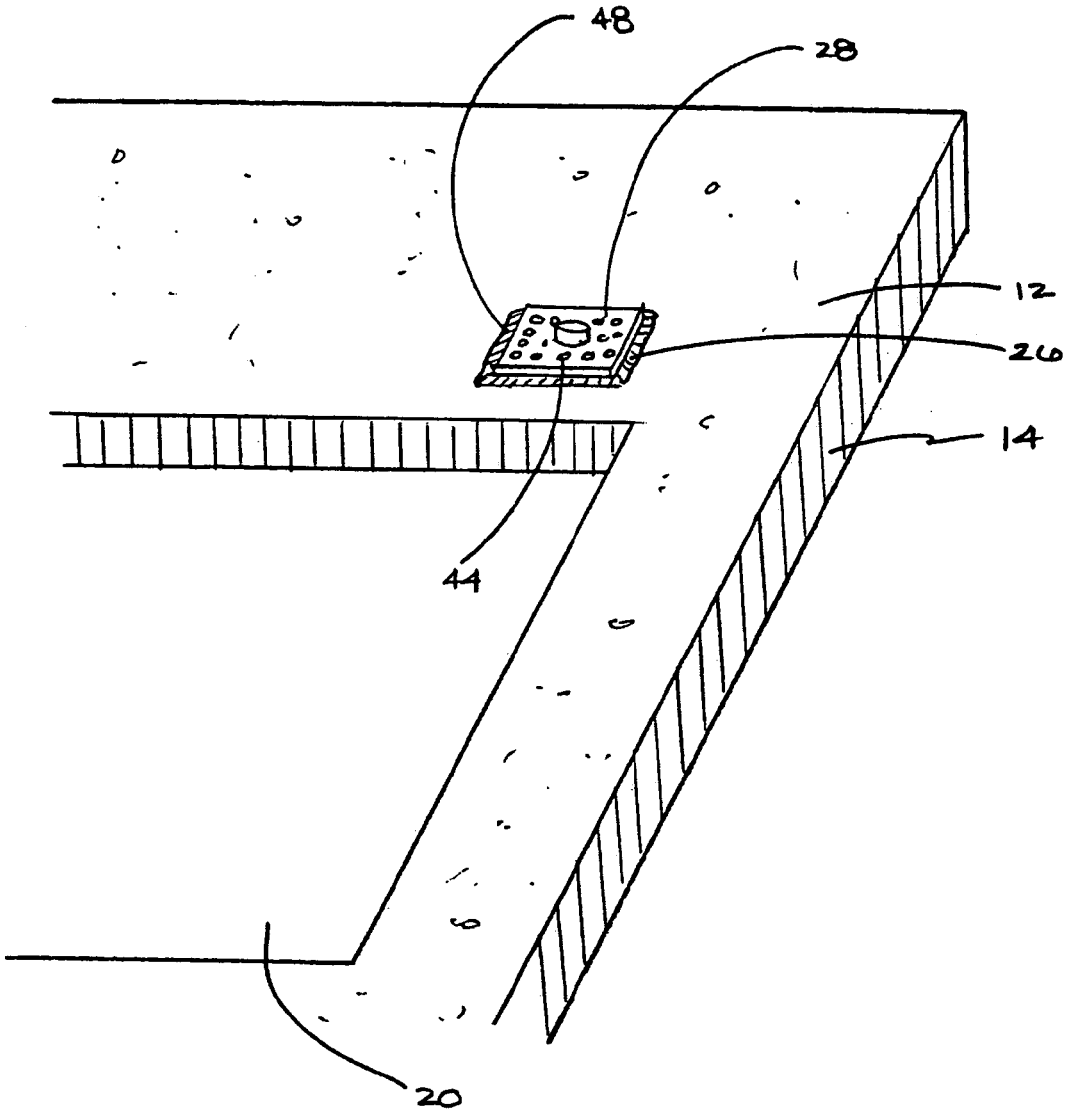
FIG. 4 is a perspective view of the mounting plate of FIG. 3 bonded to a first layer of a seaming compound.

Referring to FIG. 4, a first layer 48 of seaming compound 26 is applied to the underside 12 of the countertop 14 proximate to the cutout 20. The top surface 34 of the mounting plate 28 is brought into contact with the first layer 48 of the seaming compound 26. The mounting plate 28 is pressed vertically into the first layer 48 of seaming compound 26 so that at least a portion of the seaming compound 26 flows through the perforations 44. The mounting plate 28 will integrally bond with the seaming compound 26 as the first layer 48 of the seaming compound 26 sets and bonds to the underside 12 of the countertop 14.

Figure 5:
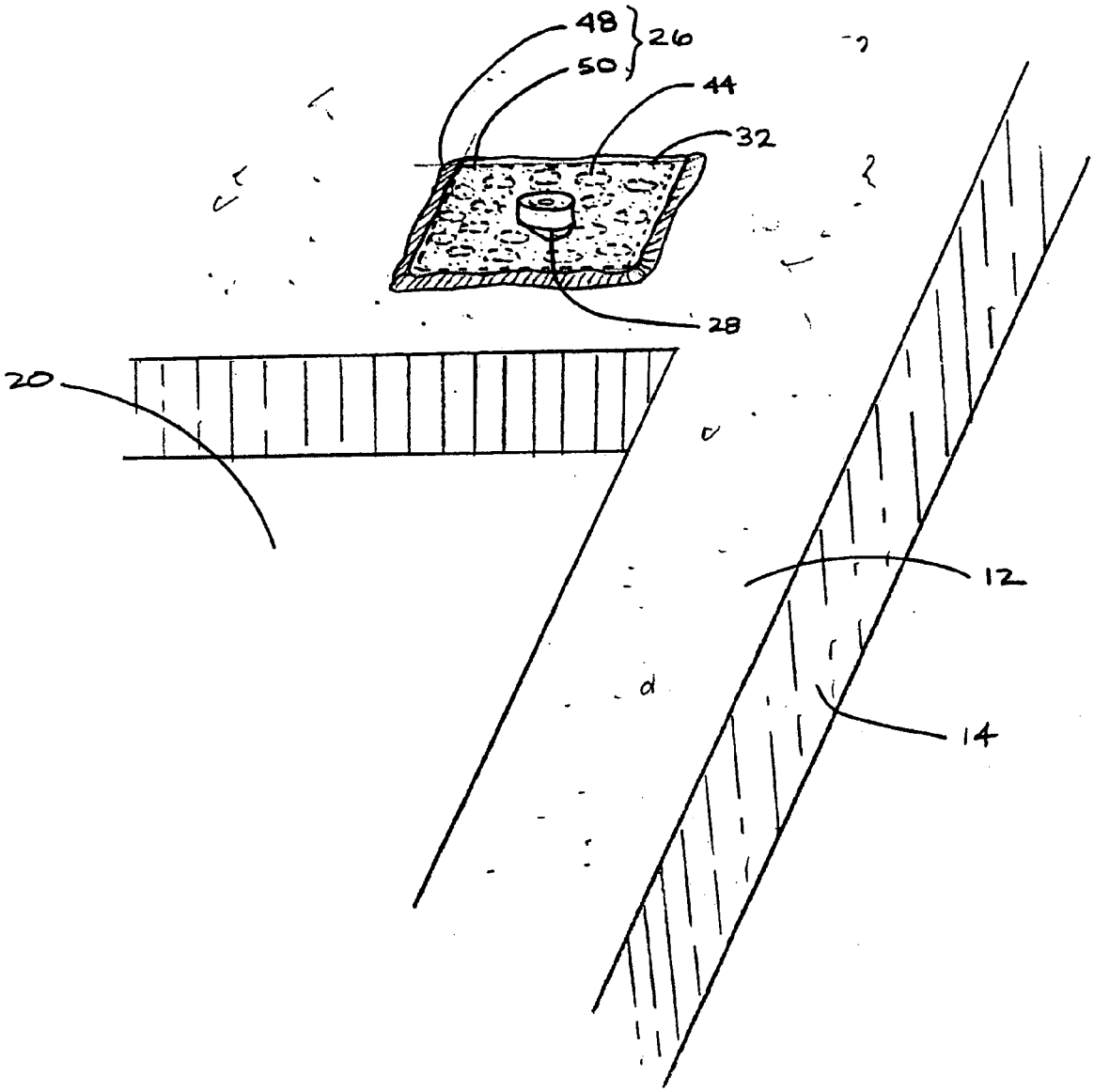
FIG. 5 is a perspective view of the mounting plate of FIG. 4 bonded with a first and second layer of the seaming compound.

As shown in FIG. 5, a second layer 48 of seaming compound 26 may be applied over the perforations 44 (shown as dashed circles) on the bottom surface 32 (shown as a dashed line) of the mounting plate 28 to integrally bond the mounting plate 28 between the first and second layers 48 and 50 of the seaming compound 26. Additionally, the second layer 50 of seaming compound 26 may also be applied around the perimeter 36 of the mounting plate 28 to increase the strength of the bond between the mounting plate 28 and the layers 48 and 50 of the seaming compound 26, and through those layers to the countertop 14.

This second layer 50 of seaming compound 26 adds additional adhering mechanisms. As a fifth mechanism, the second layer 50 of seaming compound 26 bonds to the buttons 46 thereby reinforcing the adherence to the surface 32 and expanding the area of effective adherence. Sixthly, the second layer 50 of seaming compound 26 adheres around the periphery of the mounting plate 28 and bonds directly to the countertop 14 and/or to any seaming material of the first layer 48 which squeezes laterally around the perimeter 36 of the mounting plate 28 as it is pressed against the countertop 14. Thus, use of the selected seaming compound ensures chemical bonding to the underside 12 of the countertop 14 and excellent mechanical adherence to the mounting plate 28.

The seaming compound 26 may be any suitable material, as for example, acrylic-based, polyester-based, cyanoacrylate-based or urethane-based compounds. The seaming compound 26 may also be any epoxy compound suitable for use with natural and/or man-made countertop materials. Preferably, the seaming compound 26 is used to create seams in solid materials. Most preferably, the same seaming compound 26 which is or was to be used to complete the seam 18 on countertop 14 is also utilized to secure the mounting device 10 to the countertop 14 and support the sink flange 24. Utilizing the same seaming compound 26 for both the seam 18 of the countertop 14 and the securement of the mounting device 10 is preferable because it simplifies the installation process. It also ensures that the mounting device 10 is secured to the countertop 14 by a compound specifically engineered to bond to the countertop material. Additionally, many countertop manufacturers specify which seaming compounds may be used in association with their products so as to ensure the structural integrity of the finished countertop and to match the pigmentation of the face colour of the countertop. For instance, Formica Corporation specifically recommends the use of Surell® Solid Surfacing Compound with its Formica® line of countertops. Applying a seaming compound other than the type specified by the manufacturer may result in a weak bond between the layers 48 and 50 of seaming compound 26, the mounting plate 28 and the underside 12 of the countertop 14.

Figure 6:
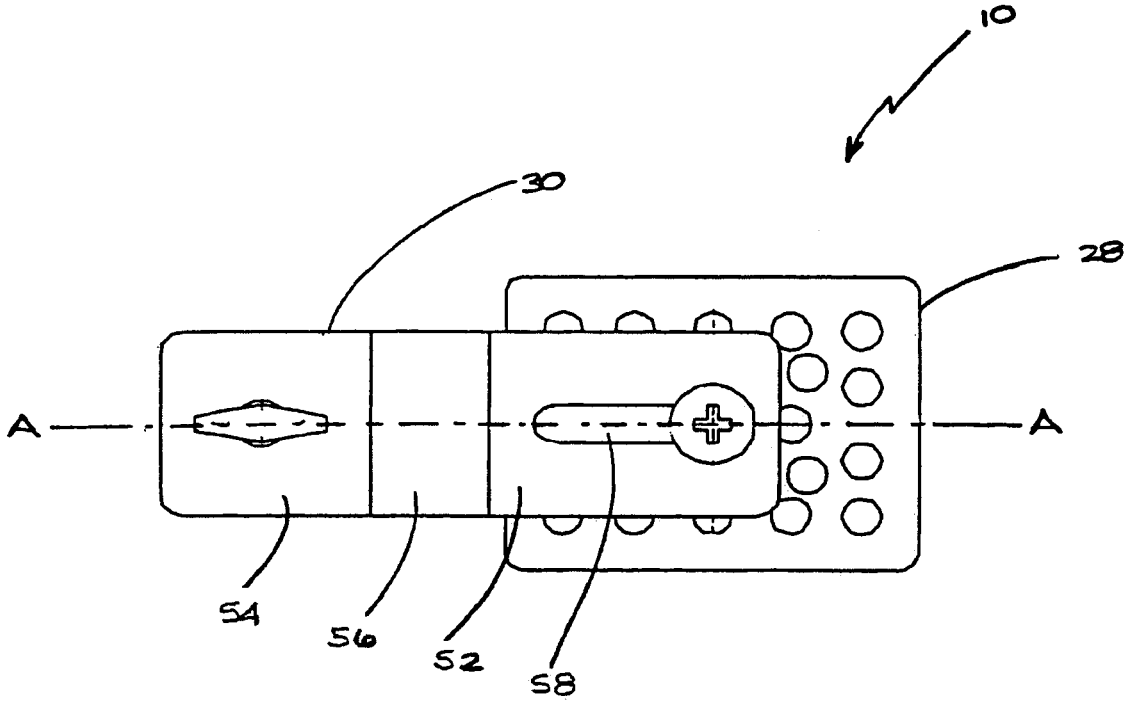
FIG. 6 is a bottom plan view of the mounting device of FIG. 2.
Figure 7:
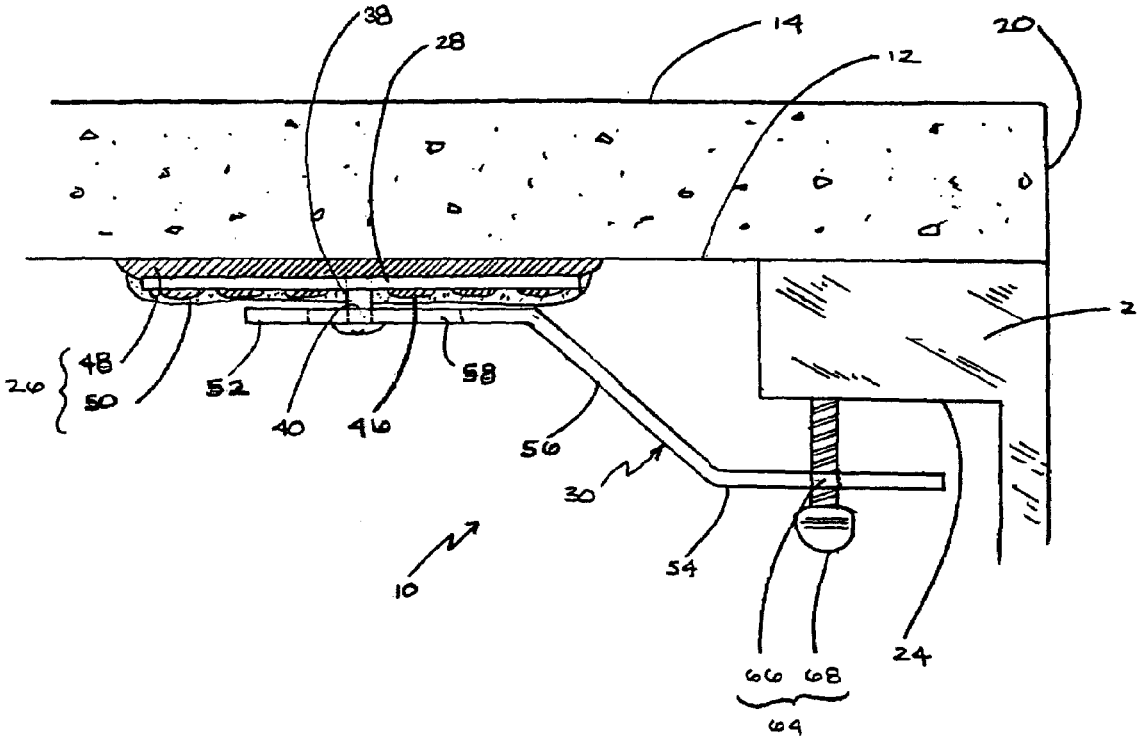
FIG. 7 is a side elevation view of the mounting device of FIG. 6 contacting and supporting a sink flange.

Once the first and second layers 48 and 50 of seaming compound 26 have substantially set, the support member 30 may be secured to the mounting plate 28. Referring to FIGS. 6 and 7, the support member 30 includes a mounting flange 52, a support flange 54 and a bridge flange 56. The mounting flange 52 has a slot 58 extending along a portion of the longitudinal axis A—A of the support member 30. The slot 58 is aligned with the aperture 40 in mounting means 38 of mounting plate 28 to permit the easy pass-through of the fastener 42. The fastener 42 is adapted to extend through the slot 58 and be received within the aperture 40 to secure the mounting plate 28 to the mounting flange 52 of the support member 30. The length of the slot 58 is sufficient so as to facilitate substantial adjustment of the support member 30 relative to the mounting plate 28. The fastener 42 may be releasably tightened in the aperture 40 to permit the support member 30 to be pivotally adjusted into an operable position beneath the sink flange 24.

Figure 8:
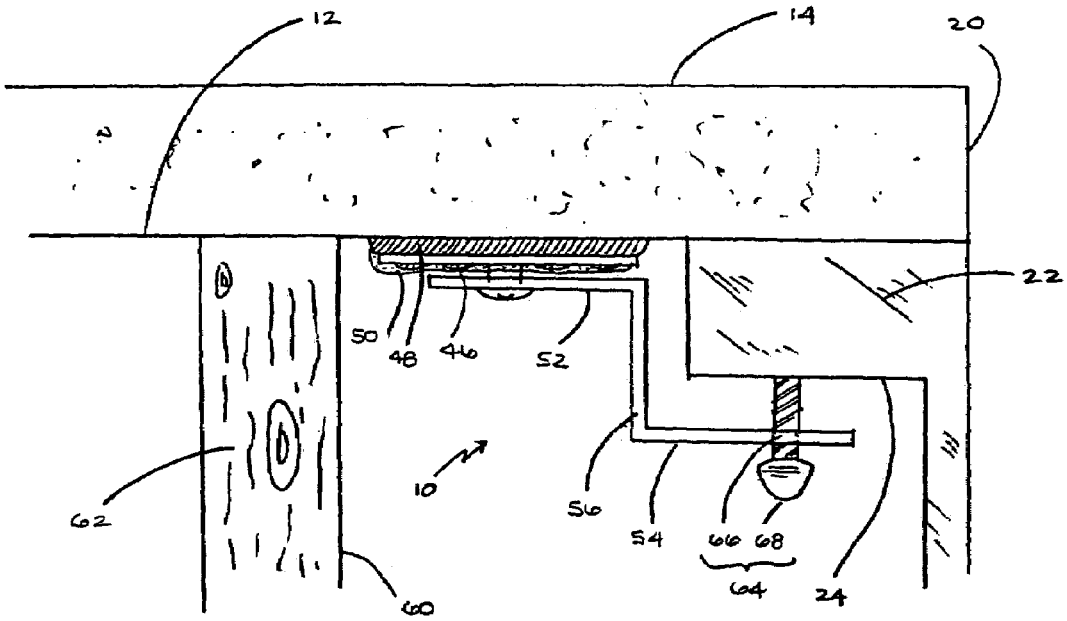
FIG. 8 is a side elevation view similar to FIG. 7 but with an alternate bridge flange.

The bridge flange 56 extends from the mounting flange 52 in a plane that is other than horizontal. For example, the bridge flange 56 may be angled generally downwardly so that the support flange 54 may be positioned beneath any variety of sink flange 24 shapes. Furthermore, the bridge flange 56 may be adapted to enable to the mounting device 10 to be mounted within the confined space within a cabinet. Referring to FIG. 8, for example, the bridge flange 56 may extend vertically for installations in which the sink flange 24 is in close proximity to a side panel 60 of the cabinetry 62.

The support flange 54 is a generally rectangular surface that is adapted to contact and support the sink flange 22. The support flange 54 may include a supporting means 64 comprising a threaded aperture 66 and a set screw 68. The set screw 68 may be releasably tightened in the threaded aperture 66 to clamp against the sink flange 24 to support the sink 22 and prevent the sink 22 from moving relative to the underside 12 of the countertop 14 during the use of the sink 22. The set screw 68 may be any suitable type of fastener, such as, for example, a bolt, which can be easily and quickly tightened by the installer installing the sink 22.

Figure 9:
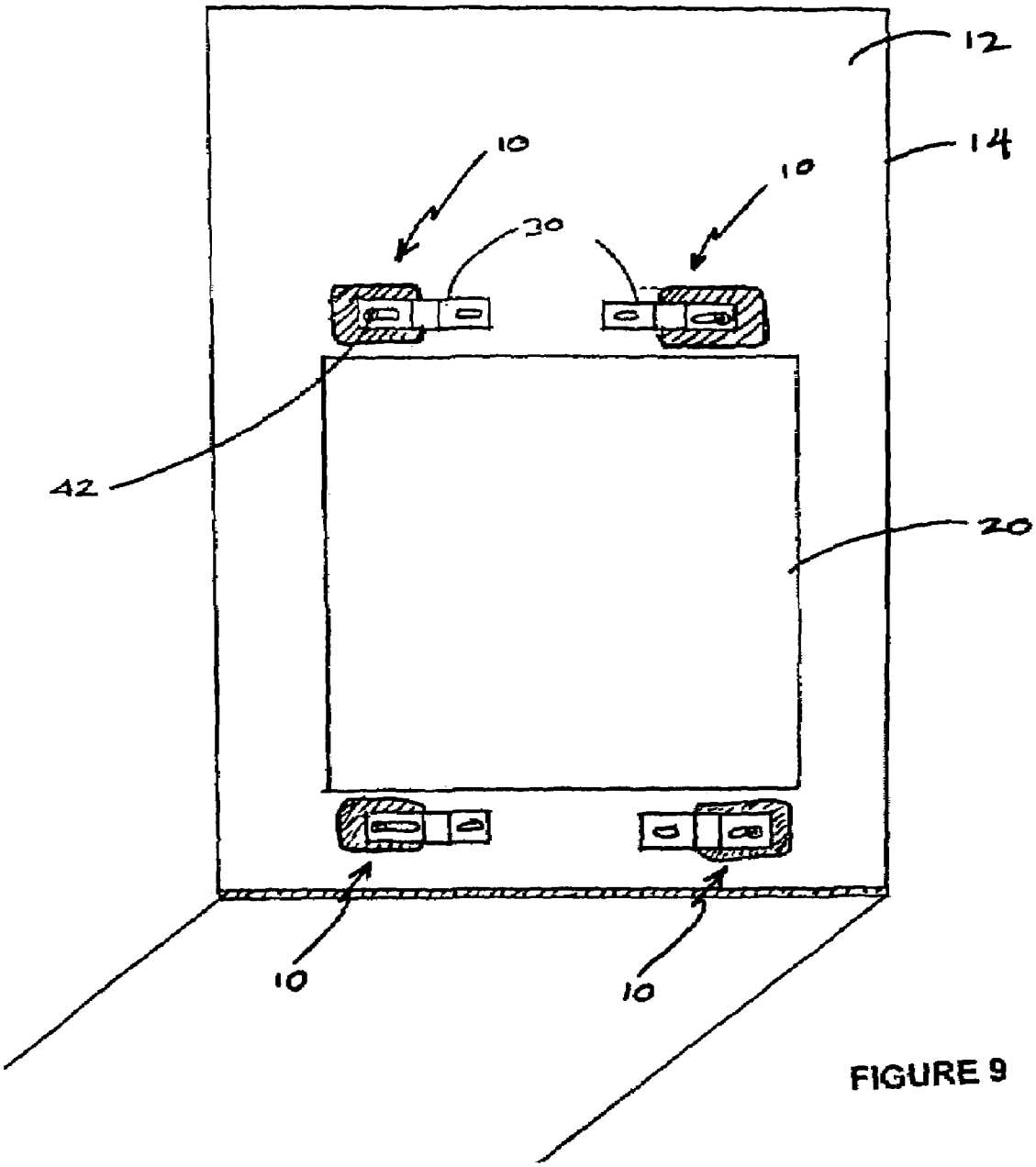
FIG. 9 is a bottom plan view of a system of mounting device and countertop with a cutout for receiving a sink in accordance with the invention.
Figure 10:
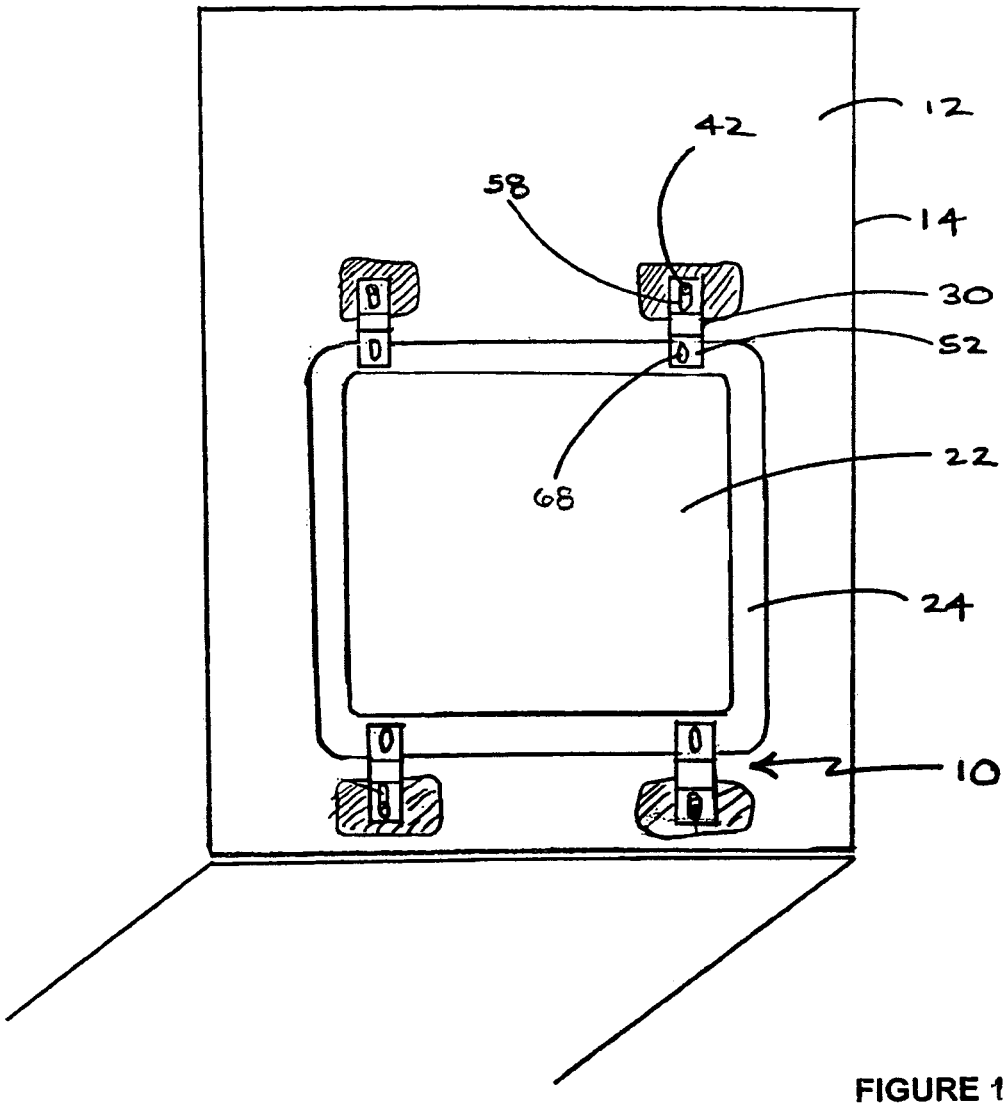
FIG. 10 is a bottom plan view of the system of FIG. 9 with mounting devices contacting and securing a sink flange.

Reference is made to FIG. 9 which shows a system including a plurality of mounting devices secured to the underside 12 of the countertop 14 proximate to the cutout 20. The mounting devices 10 are spaced from each other in a generally horizontally extending array. The support members 30 have been pivotally adjusted around the fasteners 42 to provide sufficient clearance for the sink 22 (not shown) to be positioned against the underside 12 of the countertop 14. FIG. 10 illustrates the sink 22 positioned against the underside 12 of the countertop 14 and the support members 30 operatively positioned beneath the sink flange 24. Once the desired adjustment to the position of the support member 30 has been made using the aperture 40, fastener 42 and slot 58, the set screw 68 may be tightened to contact and support the sink flange 24. It will be noted that the support flange 54 could alternatively be used to directly contact the sink flange 24 and support the sink 22 in applications where the use of the set screw 68 would damage the sink 22. For instance, sinks manufactured from fragile materials, such as porcelain, may crack if the set screw 68 is over tightened.

In use, a plurality of mounting devices 10 are used to secure a sink 22 having a sink flange 24 against the underside 12 of a countertop 14. A plurality of first layers 46 of the seaming compound 26 are applied between the underside 12 of the countertop 14 and the top surfaces 34 of the mounting plates 28, and the mounting plates 28 are pressed into the seaming compound 26. The mounting plates 28 may be spaced from each other in a generally horizontally extending array. A second layer 50 of seaming compound 26 may be applied to the bottom surfaces 32 and perimeters 36 of the several mounting plates 28 to bond the mounting plates 28 integrally between the layers 48 and 50 of seaming compound 26, and thereby to the surface 12 of the countertop 14. The mounting flanges 52 of support members 30 are then releasably secured to the mounting plates 28 using apertures 40, fasteners 42 and slots 58. The support flanges 54 are pivotally adjusted into an operable position to contact and support the sink flange 24. The adjustable mounting devices of the present invention are capable of solidly mounting most commercially available sinks to the underside of a countertop. They also provide a wide range of adjustments which enable the subject mounting device to be installed in confined spaces.

It will be noted that while four mounting devices 10 are shown along the sink flange 24 of the sink 22, any suitable number of mounting devices 10 may be used to support and secure the sink 22, depending on the nature of the specific application.

While what has been shown and described herein constitutes the preferred embodiments of the subject invention, it will be understood that various modifications and adaptations of such embodiments can be made without departing from the present invention, the scope of which is defined in the appended claims.

What is claimed is:

1. A method of attaching a mounting device for undermount securing a sink to a countertop, said countertop made from solid material selected from the group consisting of naturally occurring materials and man-made materials, comprising:

selecting a sink, said sink includes at least one sink bowl and at least one sink flange;

selecting a seaming compound which seaming compound is intended for creating seams in said selected solid material;

providing a mounting device, said mounting device including a mounting plate, said mounting plate including a plurality of perforations wherein the perforations are sufficiently large to permit said seaming compound to flow therethrough, and wherein each mounting device includes a support member, said support member including a mounting flange and a support flange, wherein said mounting flange is adapted for retaining said support member to said mounting plate, and wherein said support flange is adapted to contact said sink flange and support said sink;

applying a first layer of said selected seaming compound between the underside of said countertop and the top surface of said mounting device;

bringing said mounting plate into contact with said first layer of said selected seaming compound; and pressing said plate into said seaming compound to force a portion of selected seaming compound wherein a second layer of said selected seaming compound is applied over said perforations and around the perimeter of said mounting plate to bond said mounting plate integrally with said first and second layers of said seaming compound to flow through said plurality of perforations; to bond said mounting plate with said first layer of said seaming compound.

2. A method of attaching as claimed in claim 1, wherein said mounting plate includes an aperture and said mounting flange includes a slot, said slot mounting device includes a bolt and said bolt is adapted to extend through said slot and to be received within said aperture to secure said mounting plate to said mounting flange.

3. A method of attaching as claimed in claim 1, wherein said support flange is adapted to clamp against said sink flange.

4. A method of attaching as claimed in claim 1, wherein said support flange includes a fastener for supporting said sink.

5. A method of attaching as claimed in claim 1, wherein said seaming compound is an acrylic-based compound.

6. A method of attaching as claimed in claim 1, wherein said seaming compound is a polyester-based compound.

7. A method of attaching as claimed in claim 1, wherein said seaming compound is a cyanoacrylate-based compound.

8. A method of attaching as claimed in claim 1, wherein said seaming compound is a urethane-based compound.

9. A method of attaching as claimed in claim 1, wherein said seaming compound is an epoxy compound.

* * * * *

UNITED STATES PATENT AND TRADEMARK OFFICE

CERTIFICATE OF CORRECTION

PATENT NO. : 6,986,174 B2
DATED : January 17, 2006
INVENTOR(S) : Richard Brown

It is certified that error appears in the above-identified patent and that said Letters Patent is hereby corrected as shown below:

Title page,
Item [73], Assignee, change "Nitro-Plan AG" to -- NIRO-PLAN AG --.

Signed and Sealed this

Twenty-eighth Day of March, 2006

JON W. DUDAS
*Director of the United States Patent and Trademark Office*